United States Patent [19]

Mürrle

[11] 4,127,985

[45] Dec. 5, 1978

[54] WATCH

[75] Inventor: Kurt Mürrle, Pforzheim, Fed. Rep. of Germany

[73] Assignee: Pforzheimer Uhren-Rohwerke Rudolf Wehner, Pforzheim, Fed. Rep. of Germany

[21] Appl. No.: 745,053

[22] Filed: Nov. 26, 1976

[30] Foreign Application Priority Data

Dec. 13, 1975 [DE] Fed. Rep. of Germany ..... 2556314

[51] Int. Cl.[2] ..... G04B 19/24

[52] U.S. Cl. ..... 58/58; 58/4 R; 58/85.5

[58] Field of Search ..... 58/58, 85.5, 4 R

[56] References Cited

U.S. PATENT DOCUMENTS

| | | | |
|---|---|---|---|
| 3,662,534 | 5/1972 | Colomb | 58/58 |
| 3,855,785 | 12/1974 | Ushikoshi | 58/58 |
| 4,037,401 | 7/1977 | Ganter et al. | 58/58 |

FOREIGN PATENT DOCUMENTS

| | | | |
|---|---|---|---|
| 372983 | 12/1963 | Switzerland | 58/58 |

*Primary Examiner*—Ulysses Weldon

[57] ABSTRACT

The watch according to the present invention includes time-indicating means, time-setting means operable to set the time-indicating means, a setting shaft which is axially movable to first and second positions and arranged to be operatively connected to the time-setting means in the first position. Also included in the watch are rotatable calendar-indicating means provided with a circular series of teeth, a calendar-correcting pinion non-rotatably mounted on the setting shaft, a calendar-correcting shaft, which extends chordally at an angle to the setting shaft and has first and second end portions, first and second pinions non-rotatably mounted on the calendar-correcting shaft on the first and second end portions thereof, respectively.

In addition, the watch includes a mounting plate having an aperture in which the second end portion is mounted to permit a pivotal movement of the calendar-correcting shaft toward and away from said setting shaft between an operative position, in which the first pinion is in mesh with the calendar-correcting pinion, and at least one inoperative position in which the first pinion is disengaged from the calendar-correcting pinion. A bell crank lever serves to operatively connect between the setting shaft and the calendar-correcting shaft.

14 Claims, 4 Drawing Figures

WATCH

Figure 1:
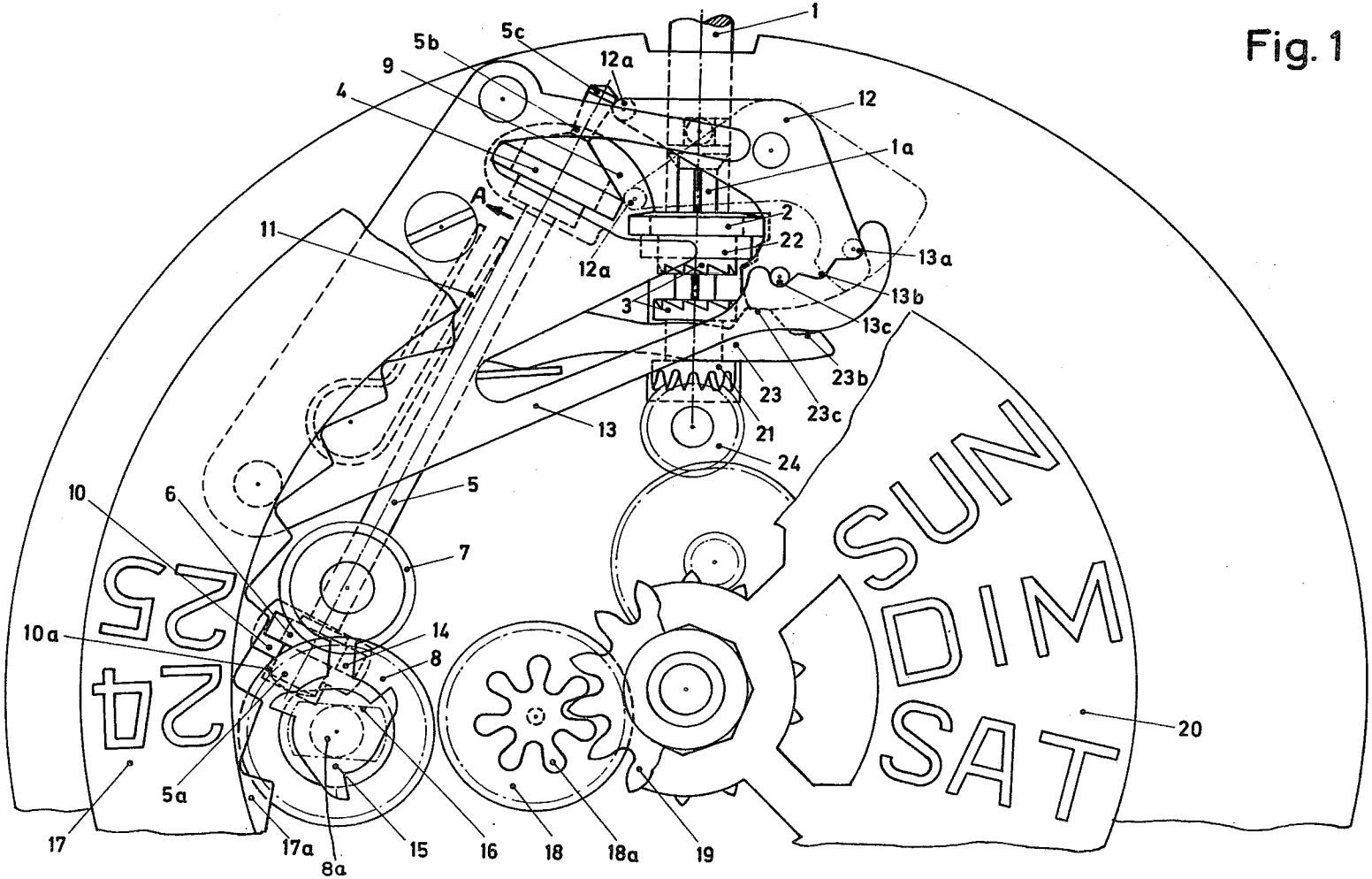

This invention relates for a calendar-correcting device for watches having a hand-setting shaft.

It is known to provide wrist watches with devices for correcting the indication of the date and of the day of the week. These devices are operable by means of the winding and/or hand-setting shaft which may be used to wind the mainspring when the crown is depressed, to set the hands when the crown is extended, and to correct the date and day indications when the crown is in a second extended position. In such watches it is difficult to accommodate the means for correcting the indications of the date and day in addition to the transmitting and shifting means of the spring-winding and hand-setting mechanisms.

In known mechanisms, the hand-setting wheel is in a fixed position and normally engages the clutch pinion and is caused to mesh with the minute wheel for setting the hands and to mesh with a correcting wheel for a calendar correction. In the known mechanisms, the meshing and disengagement of these wheels must be extremely gently because this rolling operation may otherwise result in a shifting of the hands. This is detrimental for the precision of the known winding mechanism comprising a clutch. The operation of the known manually operable mechaism for date and day correction may result in damage in certain positions of the mechanism for automatically advancing the date or day indication. Slip couplings must be incorporated in the known mechanism to avoid such damage.

It is an object of the invention to avoid these disadvantages. This object is accomplished according to the invention in that the device for correcting the date and/or day indication of watches comprising a hand-setting shaft is characterized in that a calendar shaft is provided, which extends at an angle to the handsetting shaft and chordally with respect to the date ring and carries a first pinion adapted to mesh with the handsetting shaft and a second pinion adapted to be operatively connected to the date ring so that the date-correcting shaft is operable to correct the date indication, said date-correcting shaft engages a mounting plate in an aperture thereof carries a pinion, which is adapted to mesh with the correcting pinion on the hand-setting shaft under spring action and by means of a bell-crank lever, which cooperates with a detent spring, it pivotally movable to disengage the hand-setting shaft when the same is in a position for winding the mainspring and/or in a position for setting the hands whereas the pinions mesh when the hand-setting shaft is in an intermediate position. As a result, the date- and day-correcting mechanism can be accommodated in a less confined zone.

In a preferred embodiment, the bell-crank lever is movable under the control of the hand-setting shaft in engagement with the upper portion of the date-correcting shaft so as to impart an outward pivotal movement thereto whereas the lower portion of the date-correcting shaft is provided with a pinion and an end pin and guided in an aperture of a mounting plate during the pivotal movement of the upper portion of the shaft. In depending on the sense of rotation of the date-correcting shaft, a pinion provided on the lower portion of the date-correcting shaft is adapted to operate a control lever which in one position causes a notched correcting wheel to be operatively connected between said pinion and gear teeth on the date ring, and in another position causes a day-correcting wheel to be operatively connected between said pinion and a notched day-indicating wheel.

Figure 2:
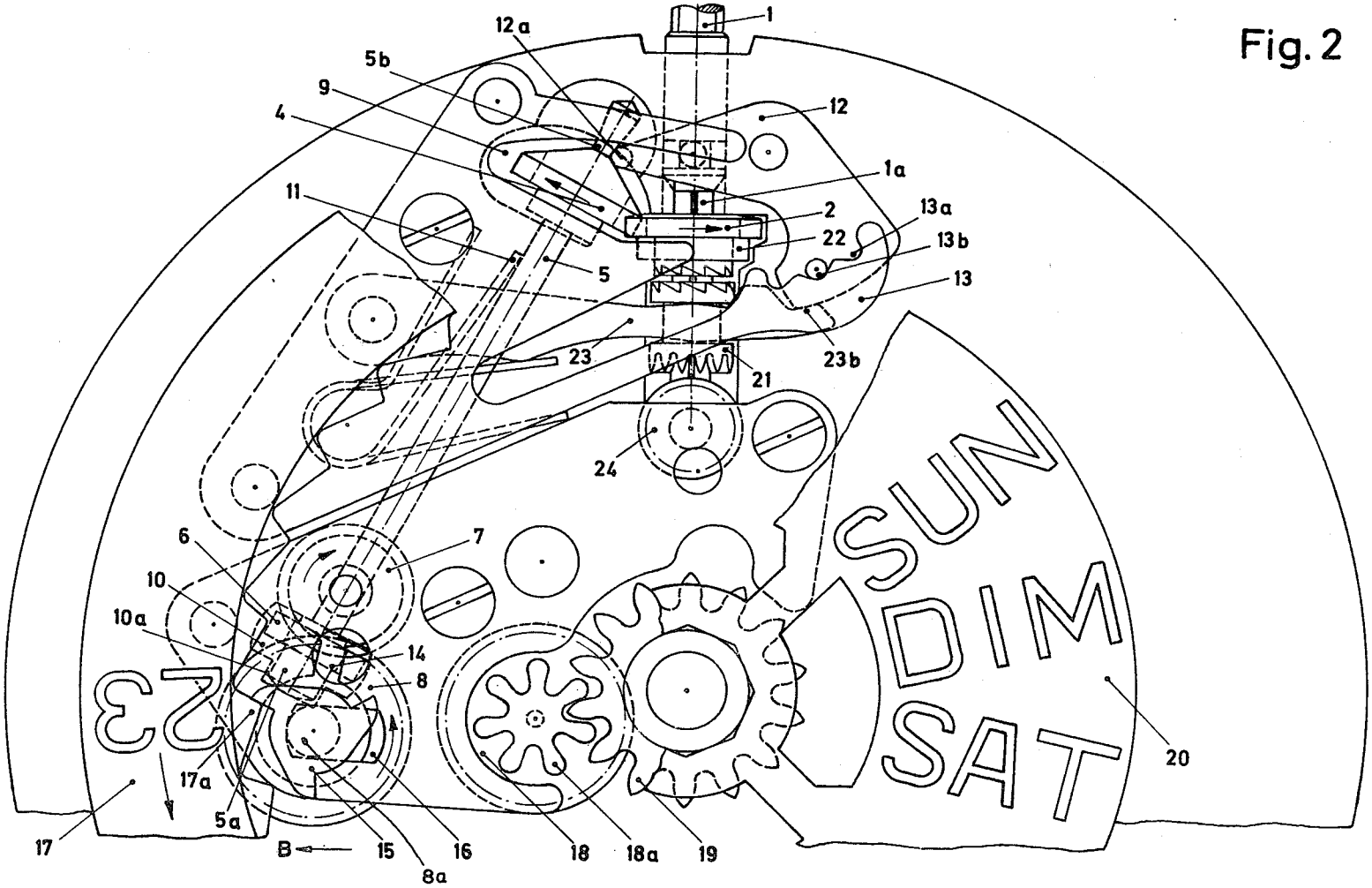
Figure 3:
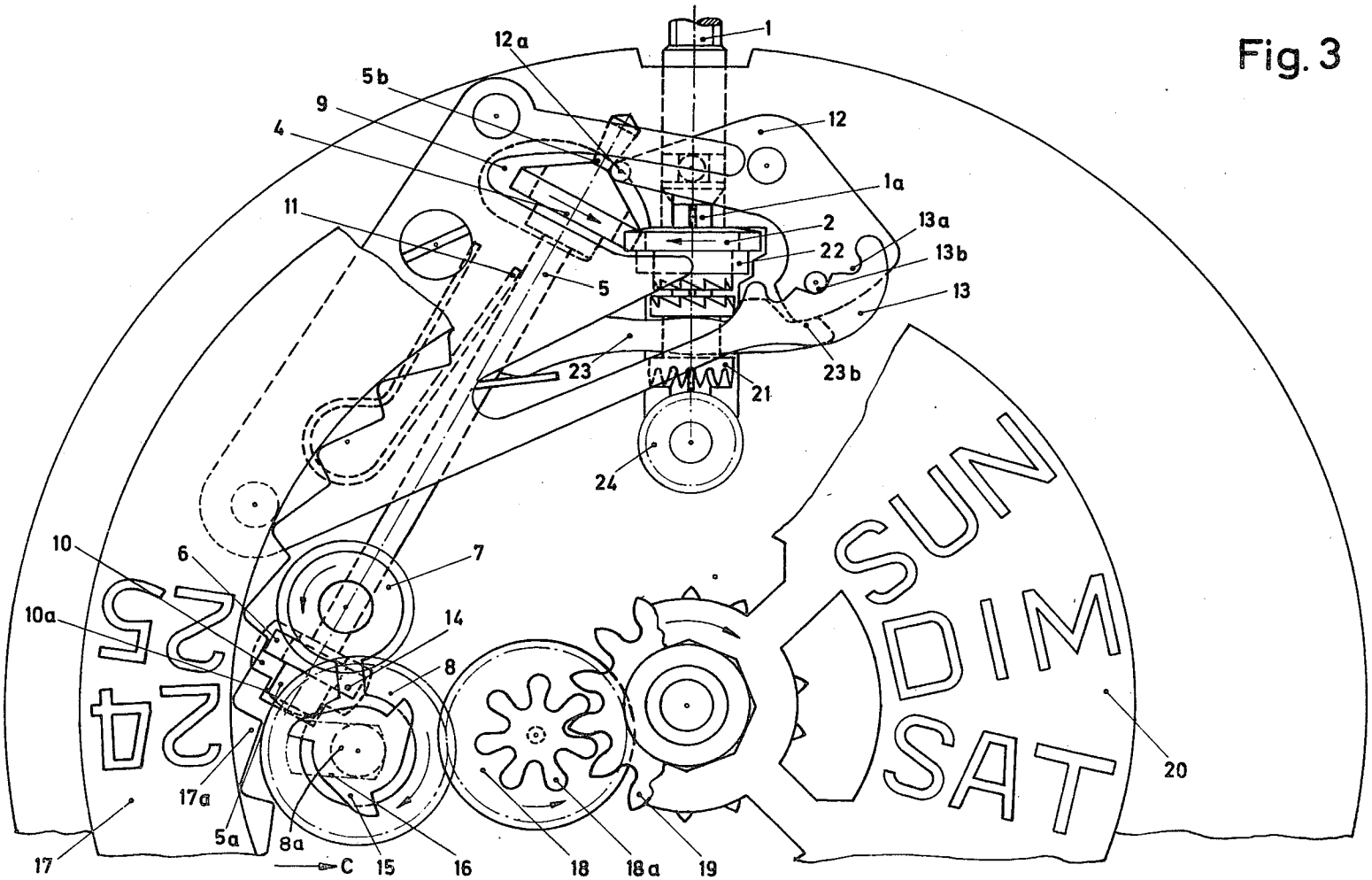
Figure 4:
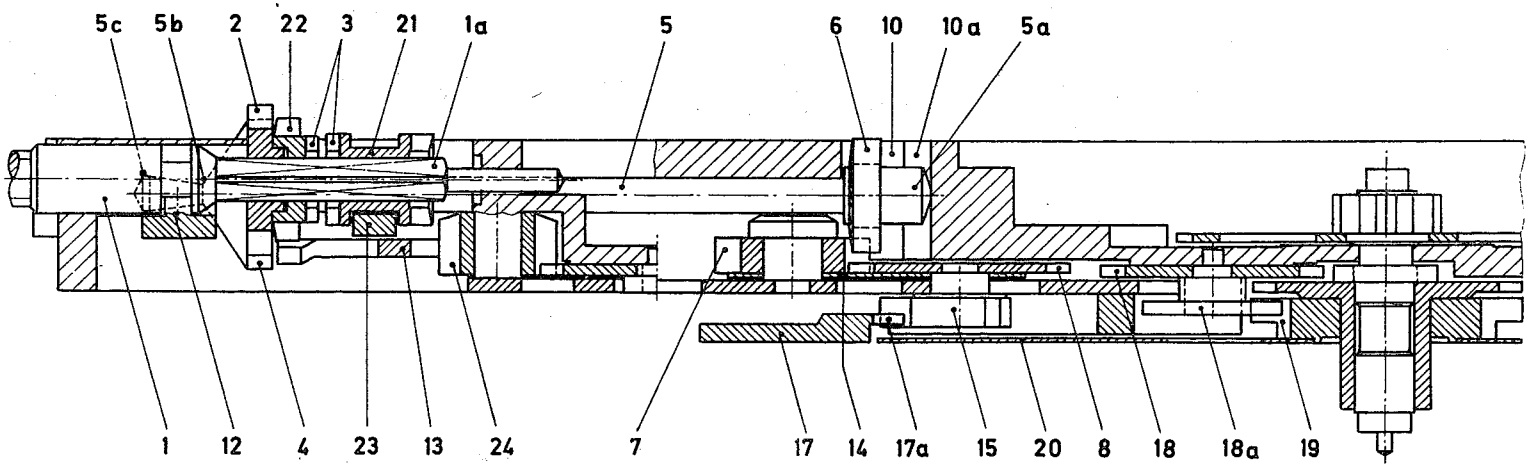

Further details of the calendar-correcting mechanism embodying the invention will be described hereinafter with reference to the drawings, in which FIG. 1 is a top plan view showing the mechanism according to the invention in its normal position, in which the hands can be set or the mainspring can be wound, FIGS. 2 and 3 are top plan views showing the mechanism in positions for date and day correction, respectively, and FIG. 4 is a sectional view showing the mechanism with the transmitting elements.

As is apparent from the drawings, a hand-setting shaft 1 carries a calendar-correcting pinion 2, which is non-rotatably mounted and axially slidably fitted on a square portion 1*a* of the shaft 1 when and only when the shaft is in its outermost position or third position, the pinion disposed above the winding wheel, which is known per se and provided with a Brequet ratchet 3. A calendar-correcting shaft 5 extends at an angle to the hand-setting shaft 1 and carries a pinion 4 in mesh with the correcting pinion 2, and carries a further pinion 6, which in dependence on its sense of rotation can be used for a date correction or day correction by means of a calendar-setting wheel 7 and a calendar-correcting wheel 8. The calendar-correcting shaft 5 is disposed in an aperture, which is formed in a mounting plate. Said aperture has an upper enlarged portion 9 for receiving the pinion 4 and lower enlarged portion 10 for receiving the pinion 6. The calendar-correcting shaft 5 is biased by a spring 11 to a position in which the pinion 4 meshes with the correcting pinion 2 on the hand-setting shaft 1. By means of a bell-crank lever 12 cooperating with a detent spring 13, the calendar-correcting shaft 5 is movable to the position shown in FIG. 1, in which the shaft 5 is disconnected from the hand-setting shaft 1 and the latter can be used to set the hands and/or to wind the mainspring. FIGS. 2 and 3 show the bell-crank lever 12 in an intermediate position, in which the pinion 4 on the calendar-correcting shaft 5 is in mesh with the pinion 2 for a calendar correction. The bell-crank lever 12 is movable by means of the hand-setting shaft 1 and adapted to be yieldably held in position by the detent spring 13 and is provided with a nose 12*a*, which is engageable with the calendar shaft 5 at its neck 5*b* adjacent to the pinion 4 to impart an outward pivotal movement to the shaft 5.

At its lower end portion near the pinion 6, the calendar-correcting shaft 5 has a terminal pin 5*a*, which is mounted in the aperture 10 in engagement with the edge of the aperture 10 at 10*a* for guiding the shaft 5 during its outward pivotal movement. The calendar-setting wheel 7 is in mesh with the pinion 6 on the calendar-correcting shaft 5 and is engaged by a control lever 14, which is aligned with the center of the wheel 7 and carries the correcting wheel 8, which carries a notched correcting wheel 15. In dependence on the sense of rotation of the wheel 7, the shifting lever 14 iscaused to shift the wheel 8 in the slot 16 to a first position, in which the notched correcting wheel 15 is in mesh with teeth 17*a* of a date ring 17 for a date correction, or to a second position in which the correcting wheel 8 is in mesh with a day correcting wheel 18, which is non-rotatably connected to a pinion 18*a*, which is in mesh with a notched day wheel 19 non-rotatably connected to a day ring 20 for a day correction. Calendar-correcting wheel 8 is non-rotatably mounted on a shiftable shaft 8a which is connected to the shifting lever 14 and extends through slot 16.

The modes of operation in the various positions of the winding and hand-setting shaft 1 will now be described.

As the crown is depressed to move the shaft 1 to its normal or first position (FIG. 1) for winding the mainspring, the nose 12a of the bell-crank lever 12 forces the calendar-correcting shaft 5 against the force of the spring 11 in direction A so that the pinion 4 is is disengaged from pinion 2. The calendar-correcting shaft extends at an angle to the shaft 1 and is offset from the winding mechanism toward the watch movement and mounted in an aperture formed in a mounting plate. A rotation of the clutch pinion 21 on the square portion 1a of the hand-setting shaft 1 will now be transmitted by the Brequet ratchet wheel 3 to the winding wheel 22.

When the hand-setting shaft 1 is pulled (second position), the bell-crank lever 12 leaves the notch 13a of the detent spring 13 and enters the intermediate notch 13b of said spring and the nose 12a of the bell-crank lever 12 is shifted to the neck 5b of the calendar-correcting shaft 5 so that the bias spring 11 causes the calendar-correcting shaft 5 to move to a position in which the pinion 4 is in mesh with the calendar-correcting pinion 2 (FIG. 2). At the same time, the bell-crank lever 12 engaging a step 23b of the clutch-operating lever 23 forces the same to a first lower position so that the clutch pinion 21 is disengaged from the winding wheel 22. The latter is non-rotatably mounted and axially slidably fitted by means of a bore on a collar of the correcting pinion 2 and on the square portion 1a when and only when the setting shaft is in its outermost or third position. In this position, the winding wheel 22 is not yet in mesh with the hand-setting wheel 24. In a winding mechanism comprising a rocker, the small wheel carried by the rocker is disengaged from the ratchet wheel but does not yet mesh with the minute wheel.

Because the winding mechanism as well as the hand-setting mechanism are disabled in that intermediate position of the bell-crank lever, the hand-setting shaft 1 can be operated to rotate the calendar-correcting pinion 2, which has square hole fitted on the square portion 1a and meshes with the pinion 4 to drive the calendar-correcting shaft 5. When the calendar-correcting pinion 2 is driven in the clockwise sense, the calendar-correcting shaft 5 and the pinion 6 thereon will be driven in the counterclockwise sense and drive the calendar-setting wheel 7 in the clockwise sense. The pressure contact between he pinion teeth causes the calendar-setting wheel 7 to be forced against the resilient correcting lever 14, which now imparts to the calendar-correcting wheel 8 pivotal movement in the direction B so that the notched correcting wheel 15 is caused to mesh with the date ring 17. The notched correcting wheel 15 rotates in the counterclockwise sense so that its teeth meshing with the teeth 17a of the date ring 17 rotate the latter by one pitch.

When the hand-setting shaft 1 is rotated in the opposite sense, the pinion 6 on the calendar-correcting shaft 5 drives the calendar-setting wheel 7 to rotate in the counterclockwise sense and the abovementioned contact pressure causes the resilient control lever 14 to turn in the direction C until it is stopped at the end of the slot 16 so that the correcting wheel 8 is in mesh with the day-correcting wheel 18. Because the correcting wheel 8 then rotates in the clockwise sense, it drives the day-correcting wheel 18 to rotate in the counterclockwise sense so that the pinion 18a connected to the wheel 18 drives the notched day-correcting wheel 19 to rotate in the clockwise sense and the day disc 20 is advanced. The backlash between the positions in which the correcting wheel 8 is in mesh with the day-correcting wheel 18 and the notched correcting wheel 15 is in mesh with the date ring 17 is so large that the correcting wheel 8 can be forced to an intermediate position during an automatic advance of the date and day indications. If blocking torques occur during a correction, the spring 11 will permit the calendar-correcting shaft 5 to yield so that damage will be avoided.

When the winding and hand-setting shaft 1 is pulled to its outermost or third position, the bell-crank lever 12 enters the notch 13c of the detent spring 13 so that the nose 12a of the bell-crank lever 12 is forced against the collar 5c of the calendar-correcting shaft 5 to hold the latter in an inoperative position against the action of bias spring 11, and to disengage the pinion 4 thereon from the calendar-correcting pinion 2. At the same time, the shifting edge of the bell-crank lever 12 engages a second stepped portion 23c of the clutch-operating lever so that the latter moves the clutch pinion 21 into engagement with the hand-setting wheel 24. During the setting of the hands, the calendar-correcting pinion 2 mounted on the square portion 1a rotates freely with the shaft 1. The operation is similar in a watch having a winding mechanism provided with a rocker because only the small pinion on the rocker drives the minute wheel.

What is claimed is:

1. A watch comprising time-indicating means, time-setting means operable to set said time-indicating means, a setting shaft which is axially movable to first and second positions and arranged to be operatively connected to said time-setting means in said first position, rotatable calendar-indicating means provided with a circular series of gear teeth, a calendar-correcting pinion non-rotatably mounted on said setting shaft, a calendar-correcting shaft, which extends at an angle to said setting shaft and has first and second end portions, first and second pinions non-rotatably mounted on said calendar-correcting shaft on said first and second end portions thereof, respectively, a mounting plate having an aperture in which said second end portion is mounted to permit of a pivotal movement of said calendar-correcting shaft toward and away from said setting shaft between an operative position, in which said first pinion is in mesh with said calendar-correcting pinion, and at least one inoperative position, in which said first pinion is disengaged from said calendar-correcting pinion, a bias spring urging said calendar-correcting shaft to said operative position, a bell-crank lever operatively connected between said setting shaft and said calendar-correcting shaft and arranged to hold said calendar-correcting shaft in an inoperative position against the action of said bias spring when said setting shaft is in said first position and arranged to permit said calendar-correctingshaft to assume said operative position when said setting shaft is in second position, resilient detent means arranged to yieldably retain said bell-crank lever in positions corresponding to said first and second positions of said setting shaft, and calendar-correcting means in mesh with said second pinion and adapted to mesh with said gear teeth.

2. A watch as set forth in claim 1, in which spring-winding means are provided, said setting shaft is axially movable to a third position to engage said spring-winding means, said bell-crank lever is arranged to hold said calendar-correcting shaft in an inoperative position against the action of said bias spring when said setting shaft is in said third position and said detent means are arranged to yieldably retain said bell-crank lever in a position corresponding to said third position of said setting shaft.

3. A watch as set forth in claim 1, in which said bell-crank lever engages said first end portion of said calendar-correcting shaft.

4. A watch as set forth in claim 1, in which said second end portion comprises a terminal pin.

5. A watch as set forth in claim 1, in which said calendar-indicating means comprise a rotatable date-indicating member having a first circular series of gear teeth and a rotatable day-indicating member having a second circular series of gear teeth, and said calendar-correcting means comprise a pinion in mesh with said second pinion, date-correcting means adapted to mesh with said first series of gear teeth and arranged to rotate said date-indicating member in response to a rotation of said calendar-correcting shaft in a first sense, and day-correcting means adapted to mesh with said second series of teeth and arranged to rotate said day-indicating member in response to a rotation of said calendar-correcting shaft in a second sense, which is opposite to said first sense.

6. A watch as set forth in claim 5, in which said date-correcting means comprise date-correcting wheel means adapted to mesh with said first series of teeth said day-correcting means comprise day-correcting wheel means adapted to mesh with said second series of teeth, said calendar correcting means comprise a first calendar-correcting wheel which is in mesh with said second pinion, a second calendar-correcting wheel in mesh with said first calendar-correcting wheel, and a shifting lever carrying said second calendar-correcting wheel and engaging said first calendar-correcting wheel and arranged to be shifted to date-correcting and day-correcting positions by said first calendar-correcting wheel in response to a rotation of said calendar-correcting shaft in said first and second senses, respectively, said date-correcting wheel means are arranged to be operatively connected to said second calendar-correcting wheel and in mesh with said first series of gear teeth when said shifting lever is in said date-correcting position, and said day-correcting wheel means are arranged to be operatively connected to said second calendar-correcting wheel and in mesh with said second series of gear teeth when said shifting lever is in said day-correcting position.

7. A watch as set forth in claim 6, in which said date-correcting wheel means comprise a notched wheel arranged to be in mesh with said first series of gear teeth when said shifting lever is in said date-correcting position.

8. A watch as set forth in claim 6, in which said shifting lever is resilient.

9. A watch as set forth in claim 6, in which said shifting lever is aligned with the axis of said first calendar-correcting wheel.

10. A watch as set forth in claim 6, which comprises means formed with a slot defining said date-correcting and day-correcting positions of said shifting lever.

11. A watch as set forth in claim 10, in which said second calendar-correcting wheel is carried by a shiftable shaft, which is connected to said shifting lever and extends through said slot.

12. A watch as set forth in claim 11, in which said second calendar-correcting wheel is non-rotatably mounted on said shiftable shaft and said date-correcting wheel means comprise a notched wheel non-rotatably mounted on said shiftable shaft and arranged to be in mesh with said first series of gear teeth when said shifting lever is in said date-correcting position.

13. A watch as set forth in claim 1, in which said setting shaft has a square portion and said calendar-correcting pinion is non-rotatably and axially slidably fitted on said square portion.

14. A watch as set forth in claim 1, in which said calendar-correcting shaft extends chordally with respect to said circular series of gear teeth.

* * * * *